US006058942A

United States Patent [19]

Eng

[11] Patent Number: 6,058,942

[45] Date of Patent: May 9, 2000

[54] MULTIPLE-COMPONENT COSMETIC PRODUCT AND METHOD OF MAKING SAME

[75] Inventor: Serena Eng, North York, Canada

[73] Assignee: Glamour Look Inc., Ontario, Canada

[21] Appl. No.: 09/348,231

[22] Filed: Jul. 6, 1999

[51] Int. Cl.[7] ..... A45D 33/00

[52] U.S. Cl. ..... 132/200; 132/293

[58] Field of Search ..... 132/293, 294, 132/303, 200; 424/63, 69

[56] References Cited

U.S. PATENT DOCUMENTS

D. 298,070 10/1988 Ferrari ..... D28/78
D. 310,763 9/1990 Ferrari ..... D28/76
D. 316,763 5/1991 Ferrari ..... D28/83
5,073,364 12/1991 Giezendanner et al. ..... 132/303
5,086,791 2/1992 Ferrari ..... 132/293

FOREIGN PATENT DOCUMENTS 406014810 1/1994 Japan ..... 132/293

*Primary Examiner*—Todd E. Manahan
*Attorney, Agent, or Firm*—Ridout & Maybee

[57] ABSTRACT

A cosmetic product includes a container, a first cosmetic material introduced to the container in a solid form, and a second cosmetic material introduced to the container in a liquid form. The second cosmetic material in the liquid form is solidified after the first cosmetic material and the second cosmetic material have been introduced to the container.

29 Claims, 7 Drawing Sheets

MULTIPLE-COMPONENT COSMETIC PRODUCT AND METHOD OF MAKING SAME

FIELD OF THE INVENTION

The present invention relates to a cosmetic product and more particularly relates to a cosmetic product having multiple distinct components of a different colour or appearance, as well as a method of making same.

BACKGROUND OF THE INVENTION

Cosmetic products such as lip glosses or lipsticks are sold in many different colours. Sometimes, several distinct and differently colored cosmetic powders or pastes will be sold in a single product. For example, cosmetic containers having several compartments for containing colored cosmetic powders or pastes of different colours have been devised.

Prior art cosmetic products have been devised to provide cosmetic powders or pastes of many different colours within a single non-compartmentalized container. For example, prior cosmetic products that include different types of cosmetic powders inside the same container have been made by using a dividing means to temporarily divide the container into adjacent sectors that are filled with different cosmetic powders. These different cosmetic powders are then individually pressed. The dividing means is then removed and all of the powders are subjected to compression to provide a uniform surface.

U.S. Pat. No. 5,086,791 is directed to a process for making a cosmetic product having powders of different colours or different characteristics. According to the process, each cosmetic powder is introduced to the container in a different stage. These different stages are interspersed with stages in which the cosmetic powders introduced are compressed. Subsequently, the layered cosmetic powders are excavated in order to expose a surface showing adjacent portions of the superimposed layers.

SUMMARY OF THE INVENTION

An object of one aspect of the present invention is to provide an improved cosmetic product including a container, a first cosmetic material and a second cosmetic material.

In accordance with an aspect of the present invention, there is provided an improved cosmetic product including a container, a first cosmetic material and a second cosmetic material. The first cosmetic material is introduced to the container in a viscous solid or gel form, and the second cosmetic material is introduced to the container in a liquid form. The second cosmetic material is subsequently solidified to a viscous solid or gel form after the first cosmetic material and the second cosmetic material have been introduced to the container, to form the finished product.

In accordance with another aspect of the present invention, there is provided an improved cosmetic product including a container, a first viscous cosmetic material and a second viscous cosmetic material. The second viscous cosmetic material surrounds the first viscous cosmetic material in the container. At least one of the first viscous material and the second viscous material has been pre-shaped to a selected shape before insertion into the container.

In accordance with a still further aspect of the present invention, there is provided a process for the production of a cosmetic product composed of distinct cosmetic materials. The process includes the following steps: (1) introducing a solid cosmetic material into a container; (2) melting a meltable cosmetic material; (3) introducing the meltable cosmetic material into the container; and, (4) after the first three steps, cooling the meltable cosmetic material to a temperature below the melting temperature.

BRIEF DESCRIPTION OF THE DRAWINGS

A detailed description of the preferred aspects of the invention are provided herein below with reference to the following drawing in which.

DETAILED DESCRIPTION OF PREFERRED ASPECTS OF THE INVENTION

Figure 1:
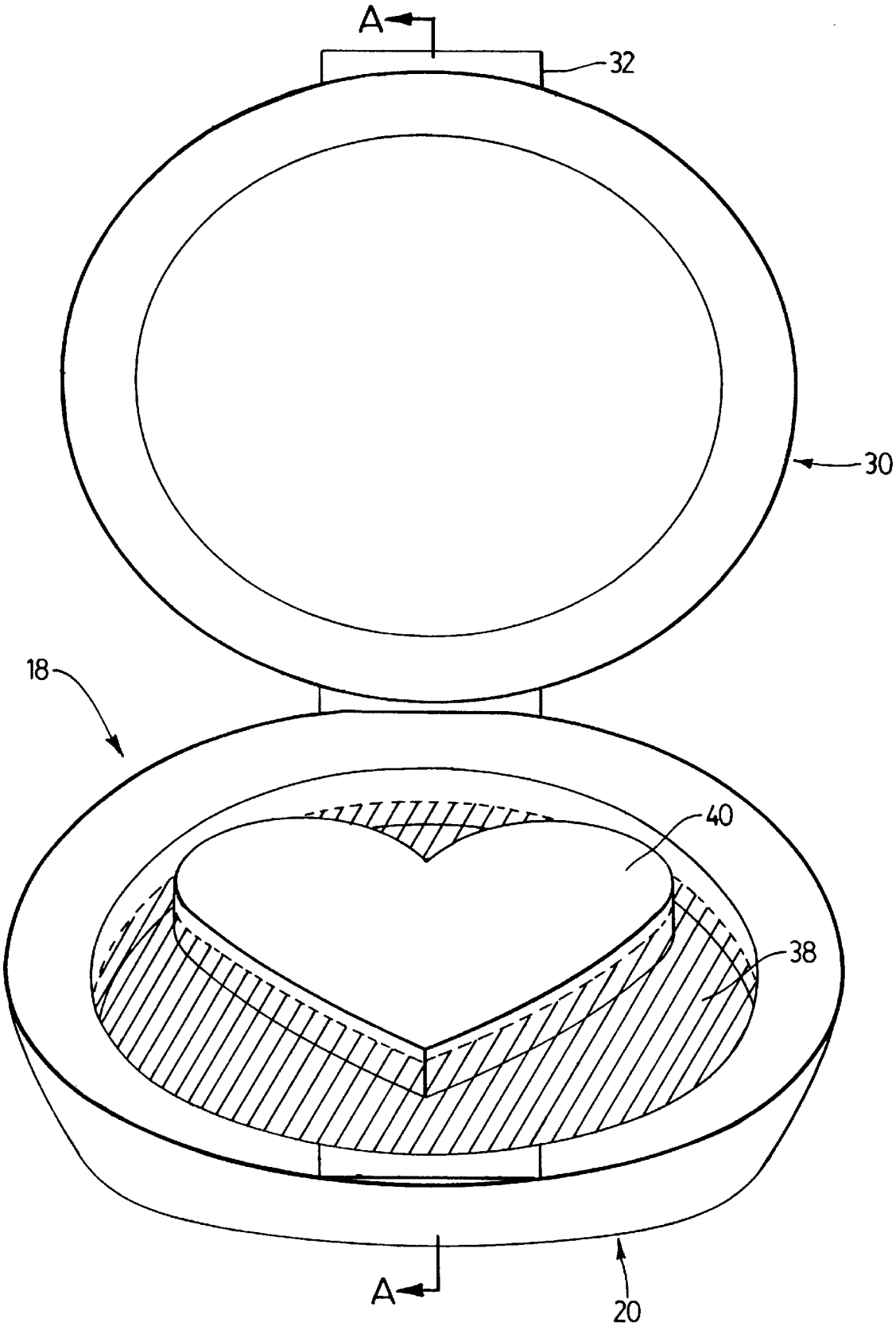
FIG. 1, in a planar view, illustrates a cosmetic product in accordance with a preferred embodiment of the invention.

Referring to FIG. 1, there is illustrated, in a planar view, a cosmetic product 18 in accordance with a preferred embodiment of the invention. The product 18 includes a container 20 that is substantially filled with cosmetic substances including a first cosmetic material 40 and a second cosmetic material 38 surrounding the first cosmetic material 40.

Figure 3:
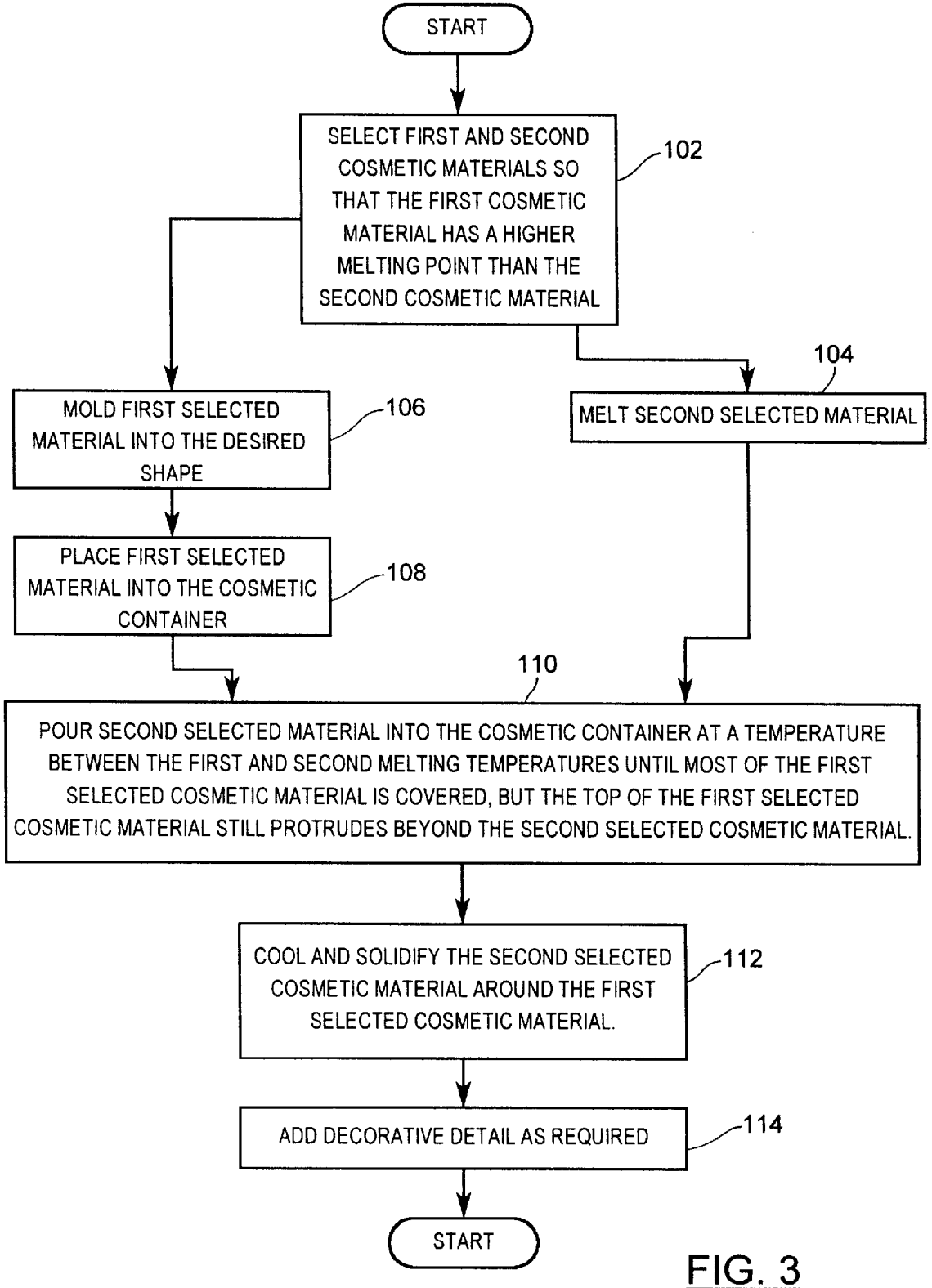
FIG. 3, is a flow chart showing the steps of a method of making the cosmetic product of FIG. 1 in accordance with a preferred aspect of the invention.

FIG. 3 shows a flow chart 100 of a method according to a preferred aspect of the invention. In a step 102 of this method, the first cosmetic material 40 and the second cosmetic material 38 are selected to have a first melting temperature and a second melting temperature where the first melting temperature is preferably above the second melting temperature and the second cosmetic material 38 is heated to above this temperature to be melted. After the selection step 102, the second cosmetic material 38 is melted in a melting step 104. Concurrently or before, the first cosmetic material 40 is formed into the desired shape in a molding step 106. After the molding step 106, the first cosmetic material 40 is placed into the container 20 in an insertion step 108. After the melting step 104 and the insertion step 108, the second cosmetic material 38 is poured into the container 20 at a temperature between the second melting temperature and the first melting temperature in order to ensure that the second cosmetic material 38 is in a liquid form, but is not sufficiently hot to melt the first cosmetic material 40. The second cosmetic material 38 is poured into the container 20 until most of the first cosmetic material 40 is submerged but the top of the first cosmetic material 40 still projects beyond the second cosmetic material 38. The second cosmetic material 38 then cools and solidifies in a cooling step 112. Decorative detail 48 may be added in a detailing step 114 after the cooling step 112. The decorative detail 44 may be added by any suitable means such as by using an eye dropper, a paint brush, or a salt shaker-like device for sprinkling the decorative detail 48 over the first cosmetic material 40.

Figure 2:
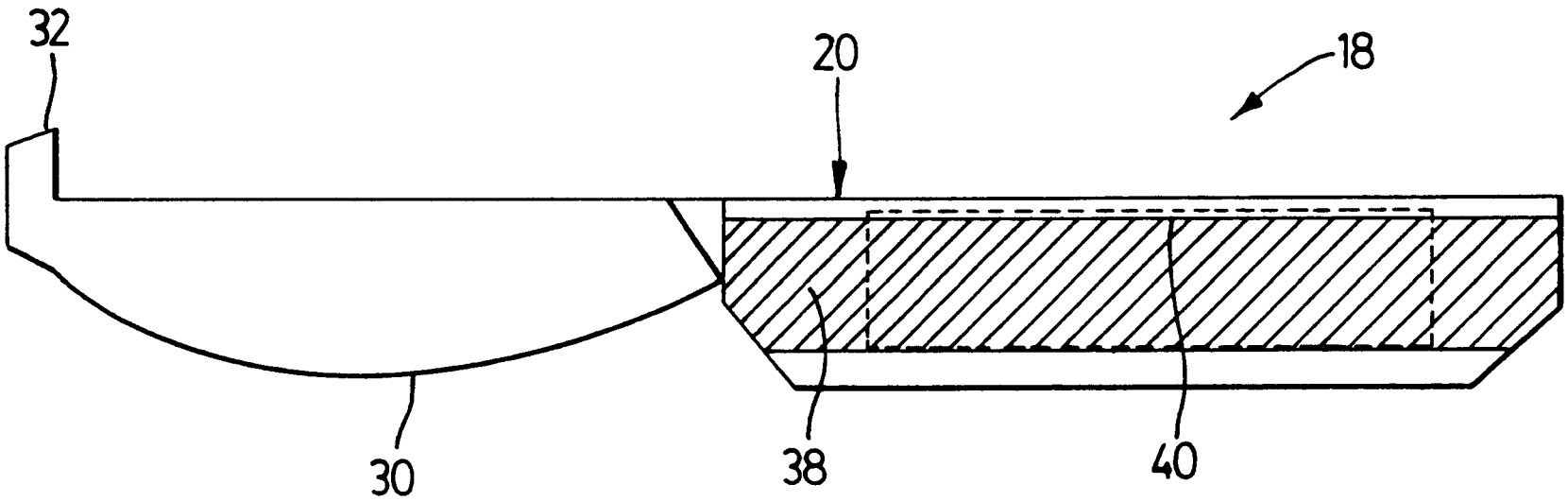
FIG. 2, in a sectional view along line A—A of FIG. 1, shows the cosmetic product of FIG. 1.

Referring to FIG. 2, there is illustrated the cosmetic product 18 in a sectional view along the line A—A of FIG. 1. As can be seen, the shape of the first cosmetic material 40 is largely preserved when the second cosmetic material 38 is poured into the container 20, and is subsequently cooled and solidified. Further, as the first cosmetic material 40 is molded to have substantially the same cross-section throughout its depth, this shape will remain apparent within the second cosmetic material 38 as the cosmetic product 18 is consumed.

Figure 4:
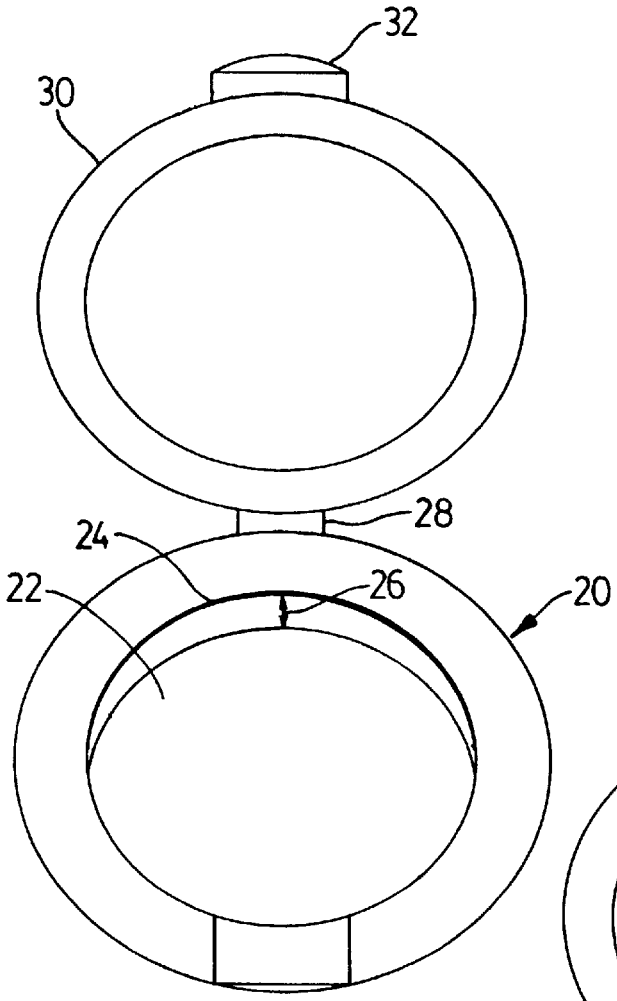
FIG. 4, in a perspective view, illustrates an empty container portion of the cosmetic product of FIG. 1.

Referring to FIG. 4, there is illustrated, in a perspective view, the cosmetic container 20 of FIG. 1 shown empty. The cosmetic container 20 includes a floor 22, which together with a lip 24 defines a cosmetic receiving reservoir of a depth 26. The cosmetic container 20 is closeable by a lid 30 that is fixed to the lip 24 of the container 20 by a hinge 28. The lid may be secured in a closed position by a catch 32.

Figure 6:
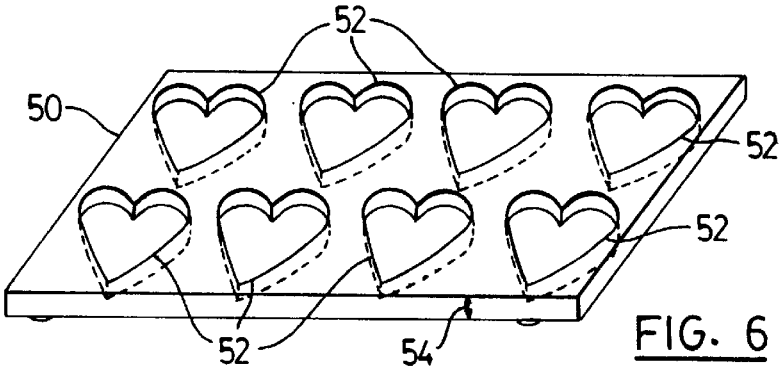
FIG. 6, in a perspective view, shows a female mold having heart-shaped molding apertures for molding heart-shaped objects of the first cosmetic material in accordance with the method of FIG. 3.
Figure 7:
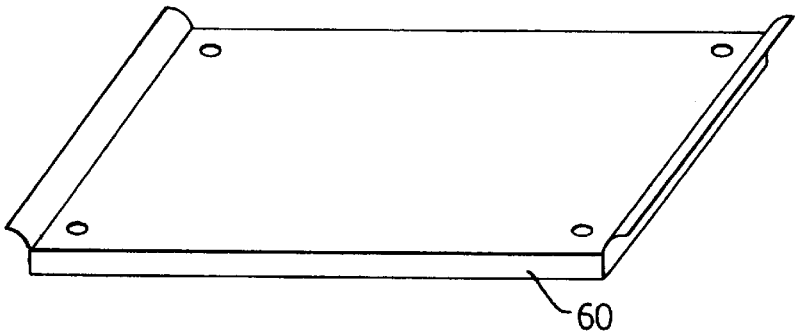
FIG. 7, in a perspective view, illustrates a base plate for receiving the female mold of FIG. 6.

Referring to FIG. 6, there is illustrated, in a perspective view, a female mold 50 having a plurality of heart-shaped molding apertures 52 suitable for use in the molding step 106 of the method of FIG. 3. The molding apertures 52 have a depth 54. Preferably, the first cosmetic material is melted and then poured into the heart-shaped mold apertures 52 and left there to cool and solidify. The female mold 50 is held on the base plate 60 (shown in FIG. 7) while the first cosmetic material is poured in the molding apertures 52. The base plate 60 provides a floor surface for the molding apertures 52. After the first cosmetic material has solidified, excess material that projects beyond the molding apertures 52 is scraped off.

Figure 9:
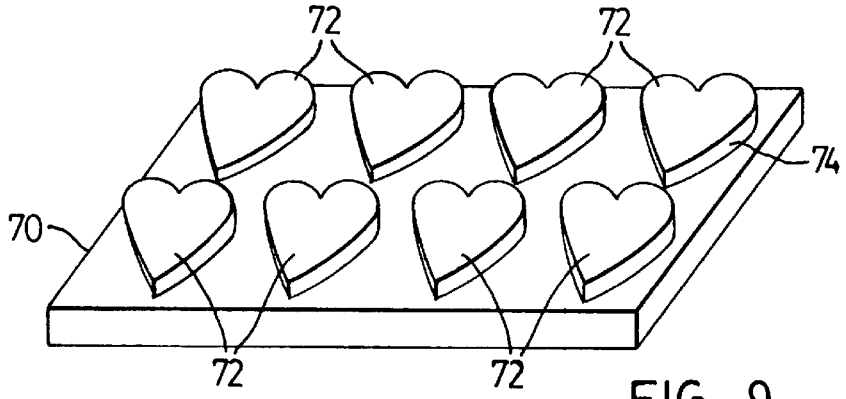
FIG. 9, in a perspective view, illustrates a male mold that mates with the female mold of FIG. 6.

Referring to FIG. 9, there is illustrated, in a perspective view, a male mold 70 having a plurality of molding projections 72 for mating with the female mold of FIG. 6. The molding projections have a projection height 74 that substantially matches or slightly exceeds the mold depth 54 of the female mold 50. After the first cosmetic material has solidified within the molding apertures 52 of the female mold 50, that base plate 60 is removed and the male mold 70 is mated with the female mold 50 to push the molding projections 72 into the molding apertures 52, thereby ejecting the heart-shaped cosmetic material from the molding apertures 52.

Figure 8:
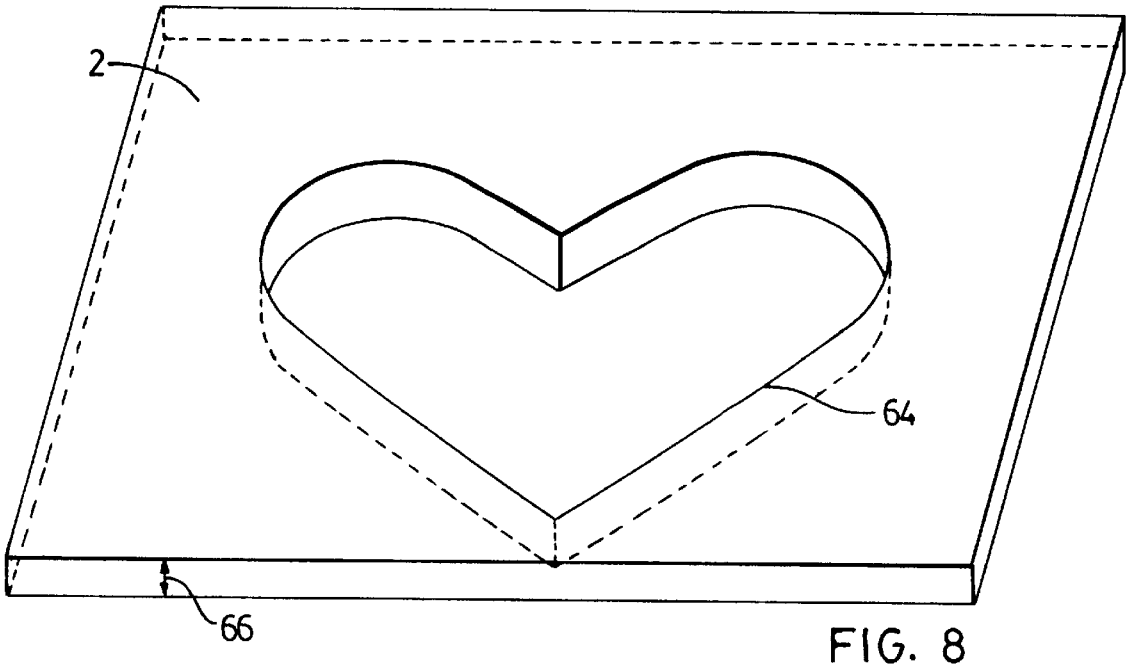
FIG. 8, in a perspective view, illustrates a singleton female mold for molding a heart-shaped object of the first cosmetic material in accordance with the method of FIG. 3.
Figure 10:
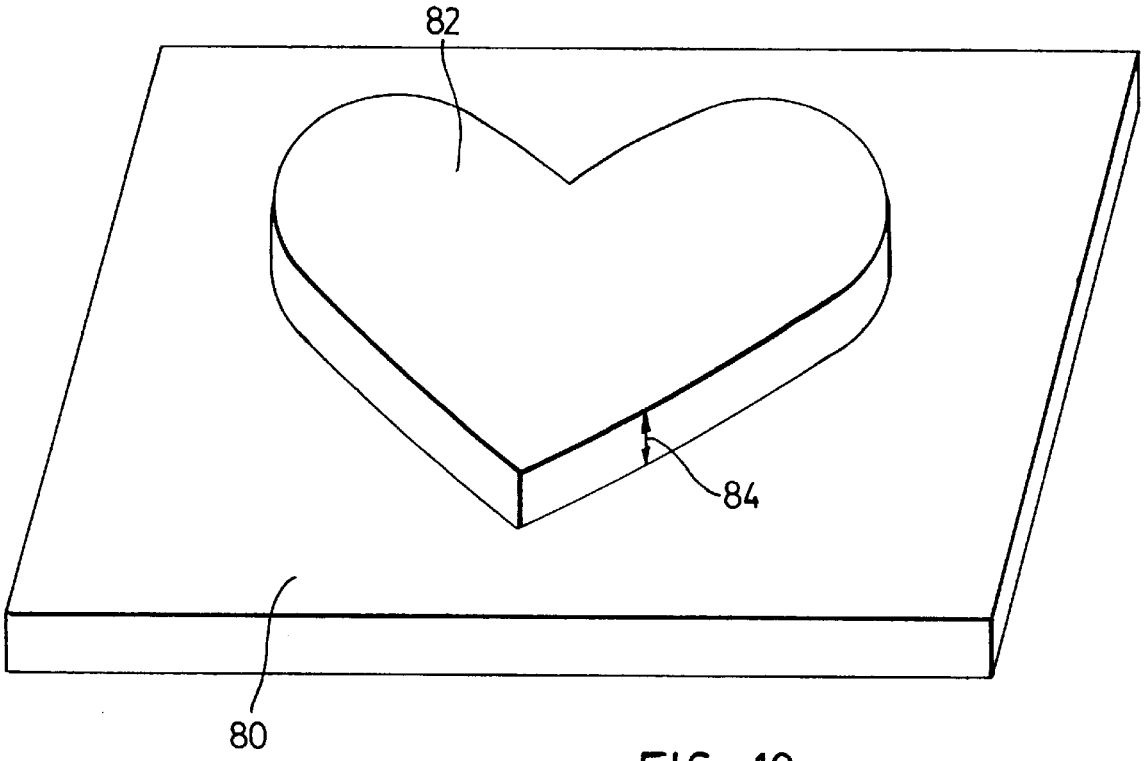
FIG. 10, in a perspective view, illustrates a singleton male mold that mates with the singleton female mold of FIG. 8; and, FIG. 11, in a perspective view, illustrates the cosmetic container of FIG. 4 containing a tree-shaped first cosmetic material to which decorative detail has been added.

Referring to FIG. 8, there is illustrated, in a perspective view, a singleton female mold 62 that may be used to form the first cosmetic material 40 into the desired shape on an individual basis in the molding step 106 of the method of FIG. 3. The singleton female mold 62 includes a molding aperture 64 having a mold depth 66. Referring to FIG. 10, there is illustrated a singleton male mold 80 having a molding projection 82 projecting to a projection height 84 that matches or slightly exceeds the mold depth 66 of the singleton female mold 62. The singleton male mold 80 and molding projection 82 are dimensioned to mate with the singleton female mold 62 and molding aperture 64. In accordance with a preferred execution of the molding step 106 of the method of FIG. 3, the first cosmetic material is poured into the singleton female mold 62 in a liquid form. The first cosmetic material is then cooled until it solidifies, at which point the excess first cosmetic material that protrudes beyond the molding aperture 64 is scraped off. Then the singleton male mold 80 is mated with the singleton female mold 62 to eject the heart-shaped first cosmetic material from the molding aperture 64.

Figure 5:
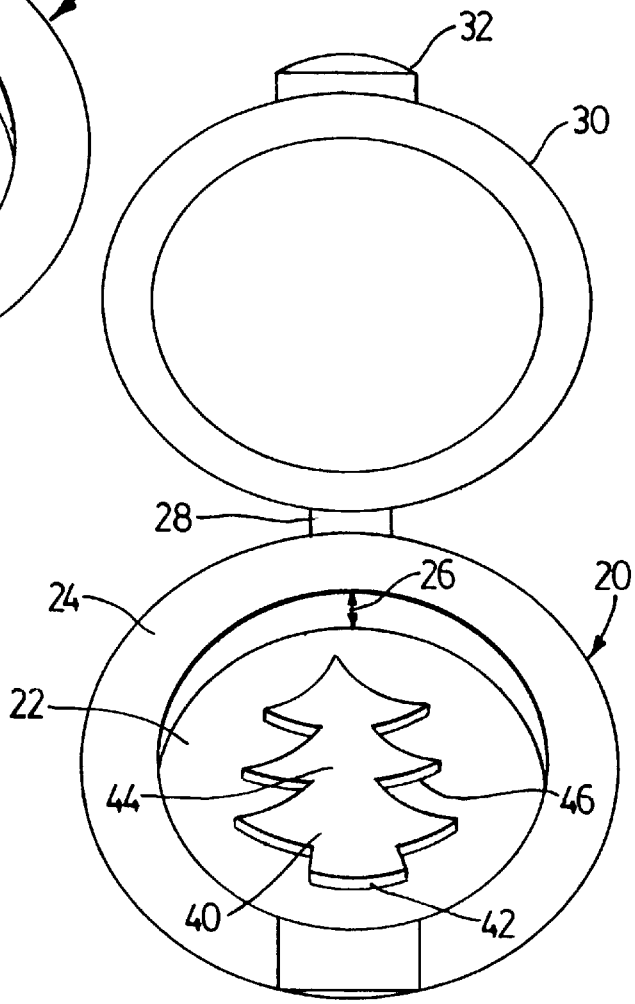
FIG. 5, in a perspective view, illustrates the cosmetic container of FIG. 4 containing a tree-shaped first cosmetic material.

It will be appreciated by those skilled in the art, that the molds may be used to make any number of different shapes, such as flowers, faces, or other symbols. Referring to FIG. 5, there is illustrated, in a perspective view, the container of FIG. 4 containing a tree-shaped first cosmetic material 40. The tree-shaped first cosmetic material 40 was formed in a manner analogous to that described above, using a tree mold set including a female mold and a male mold. After the tree-shaped first cosmetic material 40 has been formed, it is placed on the floor 22 of the container 20.

Figure 11:
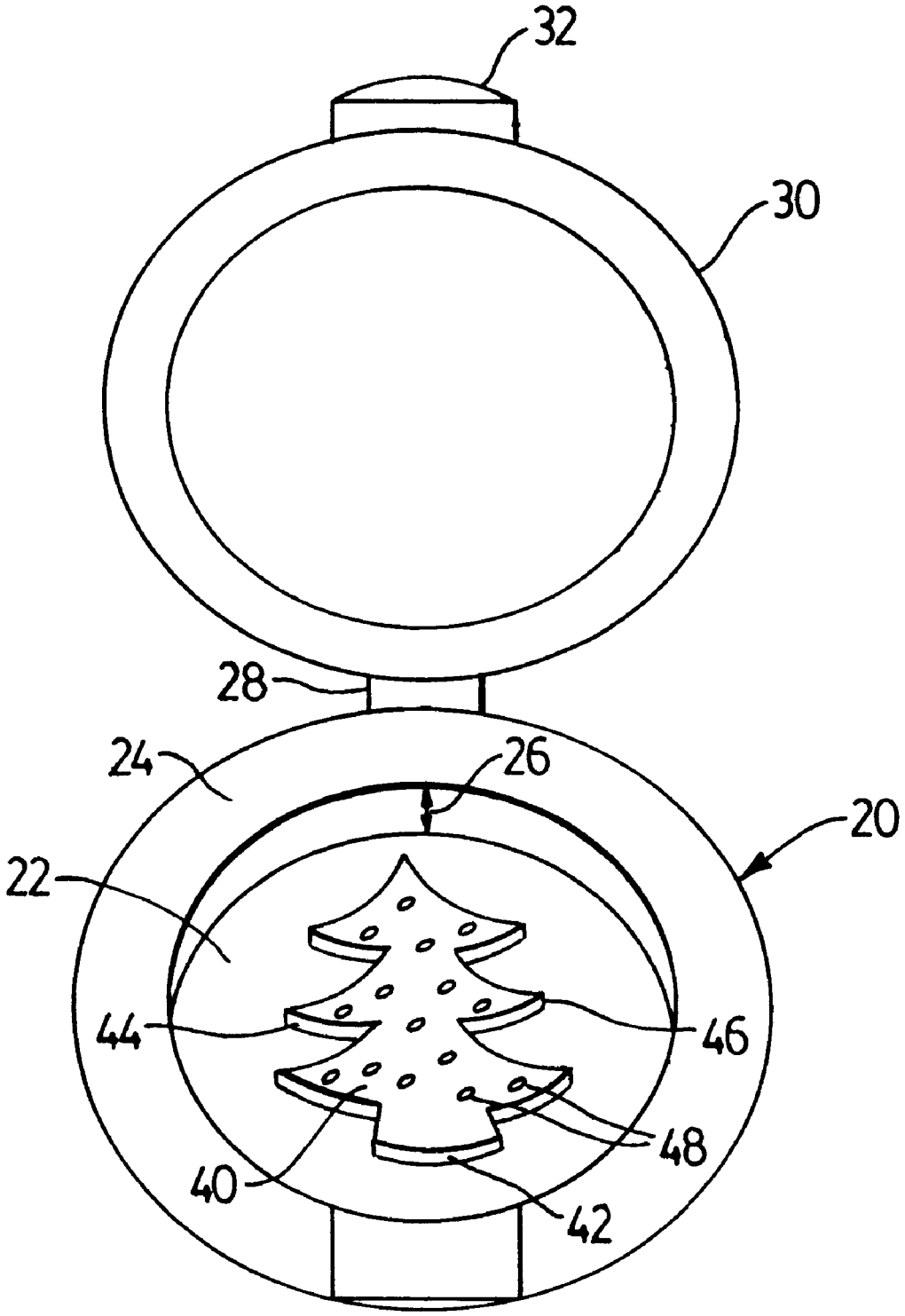

Referring to FIG. 11, there is illustrated, in a perspective view, the container of FIG. 4 containing a tree-shaped first cosmetic material 40 to which decorative detail 48 has been added. The decorative detail 48 may be added by any suitable means such as by using an eye dropper, a paint brush, or a salt shaker-like device for sprinkling the decorative detail 48 over tree-shaped first cosmetic material 40 after the second cosmetic material 38 has solidified around the tree-shaped first cosmetic material 40.

Other variations and modifications of the invention are possible. For example, multiple shapes may be placed in the cosmetic container before the second cosmetic material is poured into the cosmetic container. These shapes may all be composed of a single solid cosmetic material, or, alternatively, may be made of many different cosmetic materials of different colors. Preferably, the solid cosmetic material or materials have a melting temperature above the temperature at which the second cosmetic material is poured into the container. However, this is not absolutely necessary, provided that the shape or shapes composed of the solid cosmetic material do not melt when the second cosmetic material is added. When the melting temperature of the first cosmetic material does not exceed the melting temperature of the second cosmetic material, melting of the first cosmetic material may be prevented by freezing the shapes formed from the first cosmetic material before exposing them to the melted second cosmetic material.

It will be further appreciated by those skilled in the art that the second cosmetic material may be poured into the container before the first cosmetic material is added in a solid form. When the first cosmetic material is subsequently added, it will be inserted into the melted second cosmetic material 38 to occupy a position within the second cosmetic material 38. In this alternative aspect of the invention, the second cosmetic material need not be poured into the container; instead, the second cosmetic material may be placed in the container, melted therein, and the first cosmetic material subsequently added to the container in a solid form. In such case, the container used would have to be able to withstand the heating and cooling required to melt the second cosmetic material. In other cases, any container suitable for containing cosmetics could be used.

If desired, the second cosmetic material need not be poured into the container at all. Instead, both the first cosmetic material and the second cosmetic material may be shaped prior to insertion into the container such that the first cosmetic material and the second cosmetic material fit together and fit into the mold. For example, the second cosmetic material may be shaped to take up the reservoir of the container except for a recess into the second cosmetic material. This recess is shaped to fit the first cosmetic material of the selected shape such that the first cosmetic material and the second cosmetic material can fit together within the container. All such modifications or variations are believed to be within the sphere and scope of the invention as defined by the claims appended hereto.

What is claimed is:

1. A process for the production of a cosmetic product composed of distinct cosmetic materials, the process comprising the steps of:

(a) introducing a viscous solid cosmetic material into a container;

(b) melting a meltable cosmetic material;

(c) introducing the meltable cosmetic material into the container; and, (d) after steps (a), (b) and (c), cooling and solidifying the meltable cosmetic material to a second viscous solid form.

2. The process as defined in claim 1 wherein steps (a) and (b) precede step (c), and step (c) comprises pouring the meltable cosmetic material into the container.

3. The process as defined in claim 1 wherein step (c) precedes step (a).

4. The process as defined in claim 3 wherein step (b) precedes step (c).

5. The process as defined in claim 2 further comprising the step of (e) shaping the solid cosmetic material to a selected configuration.

6. The process as defined in claim 5 wherein step (e) precedes step (a).

7. The process as defined in claim 5 wherein the solid cosmetic material has a first appearance and the meltable cosmetic material has a second appearance different from the first appearance.

8. The process as defined in claim 7 wherein the solid cosmetic material is of a first color and the meltable cosmetic material is of a second color different from the first color.

9. The process as defined in claim 7 wherein step (e) comprises shaping the solid cosmetic material to have a base and a top projecting from the base;

step (a) comprises placing the base of the solid cosmetic material in the selected configuration close to a floor of the container; and step (c) comprises pouring the meltable cosmetic material into the container to a level wherein most of the solid cosmetic material is covered by the meltable cosmetic material, the top of the solid cosmetic material remaining uncovered by the meltable cosmetic material.

10. The process as defined in claim 7 wherein the solid cosmetic material is selected to be meltable and to have a first melting temperature;

the meltable cosmetic material is selected to have a second melting temperature lower than the first melting temperature; and, step (c) comprises pouring the meltable cosmetic material into the container at a temperature between the first melting temperature and the second melting temperature.

11. The process as defined in claim 6 wherein step (e) comprises molding the solid cosmetic material in the selected configuration to have a base of a selected shape and a side extending from the base at a constant orientation to the base to give the solid cosmetic material in the selected configuration the selected shape at a plurality of cross-sections taken along the side.

12. The process as defined in claim 1 wherein step (a) comprises introducing a plurality of objects into the container, each object being made of an associated solid cosmetic material.

13. The process as defined in claim 3 further comprising the step of (e) shaping the solid cosmetic material to a selected configuration.

14. The process as defined in claim 13 wherein the solid cosmetic material has a first appearance and the meltable cosmetic material has a second appearance different from the first appearance.

15. The process as defined in claim 14 wherein the solid cosmetic material is of a first color and the meltable cosmetic material is of a second color different from the first color.

16. The process as defined in claim 15 further comprising, after step (d), adding a plurality of colored materials to the solid cosmetic material and to the meltable cosmetic material to add decorative detail to the cosmetic product.

17. The process as defined in claim 3 wherein step (a) comprises introducing a plurality of objects into the container, each object being made of an associated solid cosmetic material.

18. The process as defined in claim 8 further comprising, after step (d), adding a plurality of colored materials to the solid cosmetic material and to the meltable cosmetic material to add decorative detail to the cosmetic product.

19. A cosmetic product comprising a container;

a first cosmetic material introduced to the container in a viscous solid form; and, a second cosmetic material introduced to the container in a liquid form wherein the second cosmetic material in the liquid form is solidified to a second viscous solid form after the first cosmetic material and the second cosmetic material have been introduced to the container.

20. The cosmetic product as defined in claim 19 wherein the first cosmetic material has a selected shape.

21. The cosmetic product as defined in claim 20 wherein the first cosmetic material is of a first color and the second cosmetic material is of a second color different from the first color.

22. The cosmetic product as defined in claim 21 wherein the first cosmetic material rests on a floor of the container and projects up through the second cosmetic material, the first cosmetic material having a top that extends out of the second cosmetic material.

23. The cosmetic product as defined in claim 19 wherein the first cosmetic material has a base of a selected shape and a side extending from the base at a constant orientation to the base to give the solid cosmetic material in the selected configuration the selected shape at a plurality of cross-sections taken along the side.

24. The cosmetic product as defined in claim 23 wherein the first cosmetic material has a top of the selected shape protruding beyond the second cosmetic material.

25. The cosmetic product as defined in claim 24 wherein the first cosmetic material has a first melting temperature and the second cosmetic material has a second melting temperature above the first melting temperature.

26. The cosmetic product as defined in claim 20 further comprising a plurality of colored cosmetic material on an exposed surface of the first cosmetic material and the second cosmetic material to add decorative detail to the cosmetic product.

27. A cosmetic product comprising a container;

a first viscous cosmetic material in the container; and, a second viscous cosmetic material surrounding the first viscous cosmetic material in the container;

wherein at least one of the first viscous material and the second viscous material has been pre-shaped to a selected shape before insertion into the container.

28. The cosmetic product as defined in claim 27 wherein the first viscous cosmetic material is added to the container in a solid form and the second viscous cosmetic material is added to the container in a liquid form, the second cosmetic material being solidified to a second viscous solid form after the first cosmetic material and the second cosmetic material have been introduced to the container.

29. The cosmetic product as defined in claim 27 wherein the first cosmetic material and the second cosmetic material are shaped to fit together and to fit into the container prior to insertion into the container.

* * * * *